US006974130B2

(12) United States Patent
Sugden

(10) Patent No.: US 6,974,130 B2
(45) Date of Patent: Dec. 13, 2005

(54) MANIPULABLE PUZZLE CUBE

(76) Inventor: Martin James Sugden, 2578 Concession Road 3, R.R. #1, Palgrave, Ontario (CA) L0N 1P0

( * ) Notice: Subject to any disclaimer, the term of this patent is extended or adjusted under 35 U.S.C. 154(b) by 0 days.

(21) Appl. No.: 10/784,991

(22) Filed: Feb. 25, 2004

(65) Prior Publication Data

US 2005/0184458 A1 Aug. 25, 2005

(51) Int. Cl.[7] ..... A63F 9/08
(52) U.S. Cl. ..... 273/153 S
(58) Field of Search ..... 273/153 S, 157 R; D21/478

(56) References Cited

U.S. PATENT DOCUMENTS

| | | | | |
|---|---|---|---|---|
| 3,065,970 A | | 11/1962 | Besley | |
| 3,178,332 A | | 4/1965 | De la Rive Box | |
| 3,222,072 A | | 12/1965 | Dreyer | |
| 4,378,116 A | | 3/1983 | Rubik | |
| 4,378,117 A | | 3/1983 | Rubik | |
| 4,405,131 A | | 9/1983 | Horvath | |
| 4,407,502 A | * | 10/1983 | Paulos | 273/153 S |
| 4,410,179 A | | 10/1983 | Rubik | |
| 4,437,667 A | * | 3/1984 | Miller | 273/153 S |
| 4,474,371 A | | 10/1984 | Silbermintz | |
| 4,511,144 A | | 4/1985 | Roberts | |
| 4,676,510 A | | 6/1987 | Agam | |
| 4,863,172 A | | 9/1989 | Rosenwinkel et al. | |
| D340,093 S | | 10/1993 | Hrsel et al. | |
| D350,164 S | | 8/1994 | Ophir | |
| 5,433,448 A | | 7/1995 | Raphael et al. | |

(Continued)

FOREIGN PATENT DOCUMENTS

| | | |
|---|---|---|
| CA | 1188342 | 6/1985 |
| FR | 887875 | 11/1943 |
| WO | WO 91/00758 | 1/1991 |

(Continued)

OTHER PUBLICATIONS

Slocum, Jerry et al., "Puzzles: Old & New: How to Make and Solve Them", 1986, Plenary Publication International, pp. 138, 139.*

(Continued)

*Primary Examiner*—Steven Wong

(57) ABSTRACT

A manipulable puzzle cube is an improvement of the classic Rubik's Cube. The puzzle cube consists of a plurality of cubic elements connected to a centrally positioned interior connecting element, the cubic elements of each surface of the cube forming a plate of cubic elements, the plate being rotatable about a spatial axis of the cube, each of the cubic elements having one or more exposed faces. All of the exposed faces of a given cubic element are the same color, the color being selected from a group of colors comprising at least two colors. The color of each cubic element is selected so that the cubic elements form a decorative pattern on each surface of the cube. The pattern may be the same on each surface of the cube, and may take the form of a "Y" or no "tic-tac-toe" pattern. The subject puzzle cube is more appealing to the eye than the classic Rubik's Cube, and its manufacture is simplified.

19 Claims, 8 Drawing Sheets

U.S. PATENT DOCUMENTS

| | | | | |
|---|---|---|---|---|
| 5,992,850 | A * | 11/1999 | Li | 273/153 S |
| 6,186,860 | B1 | 2/2001 | Liao | |
| 6,422,560 | B1 * | 7/2002 | Harbaugh | 273/157 R |
| D475,094 | S | 5/2003 | Ko | |
| 6,626,431 | B2 | 9/2003 | Possidento | |
| D495,378 | S * | 8/2004 | Sugden | D21/478 |
| 2001/0033056 | A1 | 10/2001 | Francis | |
| 2002/0167127 | A1 | 11/2002 | Fang | |
| 2003/0232636 | A1 | 12/2003 | Ionescu | |

FOREIGN PATENT DOCUMENTS

| | | |
|---|---|---|
| GB | 2171609 | 9/1986 |
| HU | 170062 | 7/1981 |

OTHER PUBLICATIONS

Twistypuzzles.com newsletter, Issue #5 http://twistypuzzles.com/newsletter/newsletter-2002-12.shtml.

* cited by examiner

MANIPULABLE PUZZLE CUBE

FIELD OF THE INVENTION

This invention relates to three-dimensional puzzles, and in particular, to manipulable puzzle cubes containing rotatable elements.

BACKGROUND OF THE INVENTION

The classic Rubik's Cube (trademark) is a 3×3×3 manipulable puzzle cube consisting of 26 cubic elements connected together by a centrally positioned, interior connecting mechanism. Groups of nine cubic elements form plates which are rotatable about the spatial axes of the cube. Each of the cubic elements has one, two or three exposed faces, and there are nine exposed faces for each of the six sides of the cube, for a total of 54 exposed faces. When the Rubik's Cube is in its starting, undisturbed condition, all of the faces on a given side are the same colour, and each side of the cube is a different colour. The object of the game is to disturb the original pattern, and then sequentially rotate the plates so as to restore each of the six sides of the Rubik's Cube to its original colour.

The Rubik's Cube has been a popular manipulable puzzle cube, over the past 25 years. However, the Rubik's Cube is difficult to solve, and there is a need for manipulable puzzle cubes which present various levels of difficulty.

In addition, the pattern of the classic Rubik's Cube is relatively plain, and users like variety. Thus there is a need for manipulable puzzle cubes having distinctive decorative patterns, which are more appealing to users.

Furthermore, in the case of the classic Rubik's Cube, plastic plates or stickers of different colours are typically applied to the faces of various cubic elements, to make each of the sides of the cube a different colour. However, these plates or stickers have a tendency to become dislodged with hard use over time. It is also relatively expensive to apply different coloured stickers or plates to the faces of each cubic element. There is accordingly a need for an improved manipulable puzzle cube which is less expensive to produce and which is more durable.

SUMMARY OF THE INVENTION

The subject invention is directed to a manipulable puzzle cube comprising a plurality of cubic elements connected to a centrally positioned interior connecting element, the cubic elements of each surface of the cube forming a plate of cubic elements, the plate being rotatable about a spatial axis of the cube, each of the cubic elements having one or more exposed faces. All of the exposed faces of a given cubic element are the same colour, and the colour is selected from a group of colours comprising at least two colours. The colour of each cubic element is selected so that the cubic elements form a decorative pattern on each surface of the cube, when the cube is in an undisturbed state. The colours are preferably contrasting colours, and the decorative pattern may be the same on each surface of the cube.

The cube of the subject invention is preferably a 3×3×3 cube comprising 26 cubic elements connected to the interior connecting element, with each surface of the cube comprising a 3×3×3 array of cubic elements, the array having three rows of cubic elements, three columns of cubic elements, and two diagonals of cubic elements.

The decorative pattern may comprise a "Y" pattern, wherein one corner element, the mid-face element and two of the mid-edge elements not adjacent to the corner element are of a first colour, and the remaining cubic elements of the surface are of a second, contrasting colour. This decorative pattern may be a no "tic-tac-toe" pattern wherein the cubic elements making up each of the rows, the columns, and the diagonals of the array are not the same colour.

Alternatively, the decorative pattern may resemble the appearance of a cake, in which the cubic elements making up the top plate are of a first colour, and the cubic elements making up the bottom two plates are of a second colour, or the decorative pattern may be a three-colour pattern, in which the cubic elements making up each of the three plates are different colours.

In another embodiment, the decorative pattern is a nine-colour pattern, wherein each of the cubic elements forming a given surface of the cube is a different colour.

BRIEF DESCRIPTION OF THE DRAWINGS

The invention will now be described, by way of example only, with reference to the following drawings, in which.

DETAILED DESCRIPTION OF THE INVENTION

Figure 1:
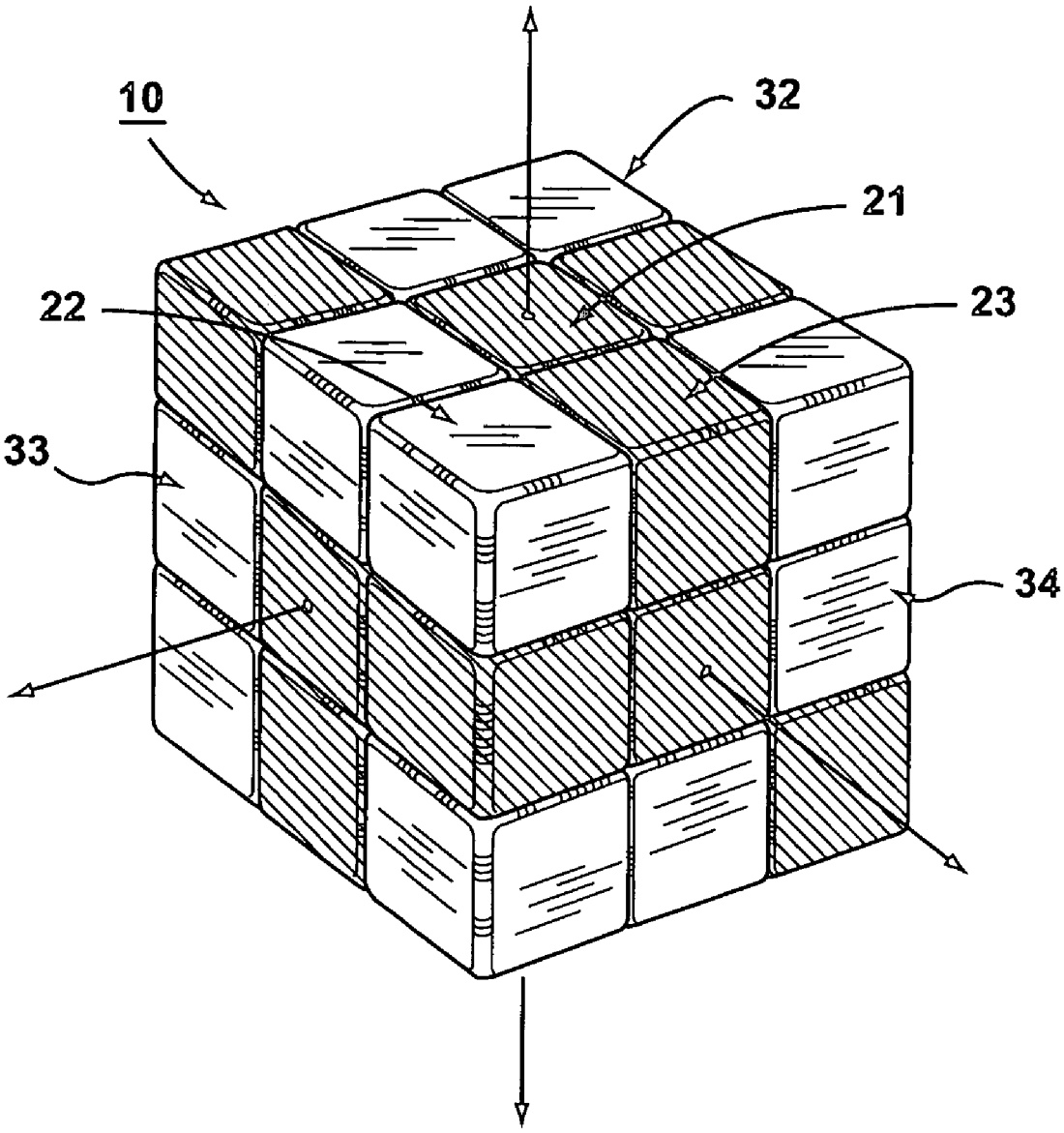
FIG. 1 is a perspective view of a manipulable puzzle cube made in accordance with a preferred embodiment of the invention.
Figure 3:
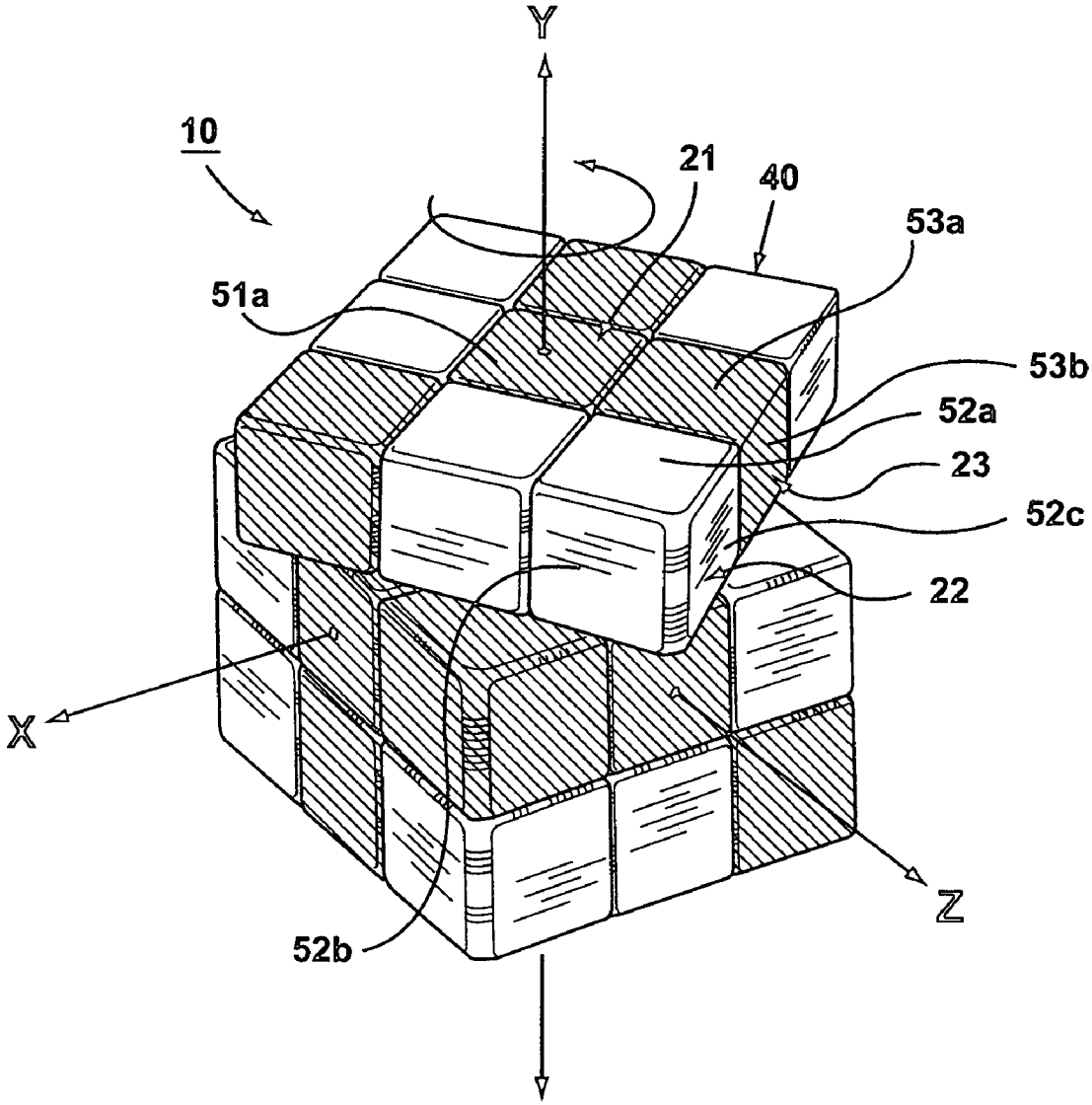
FIG. 3 is a perspective view of the manipulable puzzle cube of the present invention, with the top plate of the cubic elements shown rotated about a spatial axis of the cube.
Figure 4:
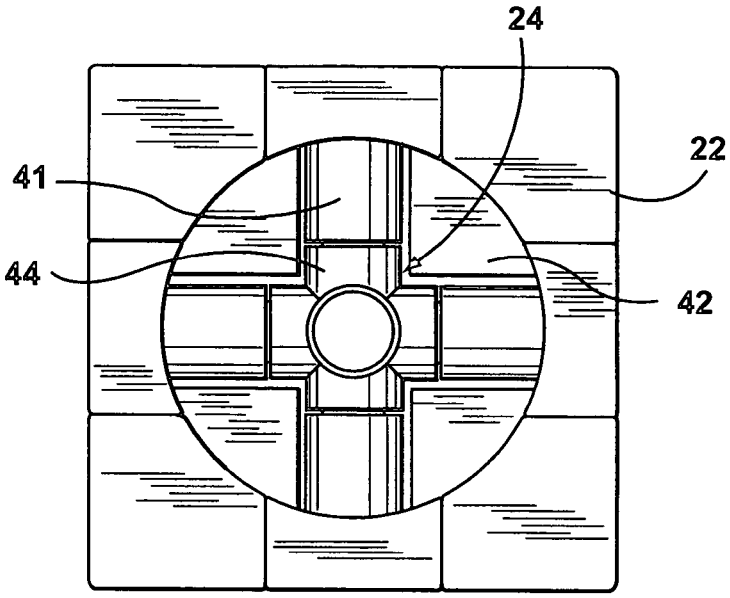
FIG. 4 is a top view of the cube with the top plate removed, revealing the internal connecting element.
Figure 5:
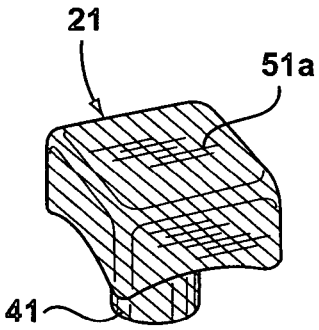
FIG. 5 is a perspective view of a mid-face cubic element.
Figure 6:
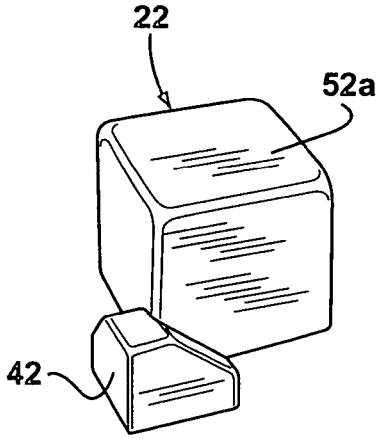
FIG. 6 is a perspective view of a corner cubic element.
Figure 7:
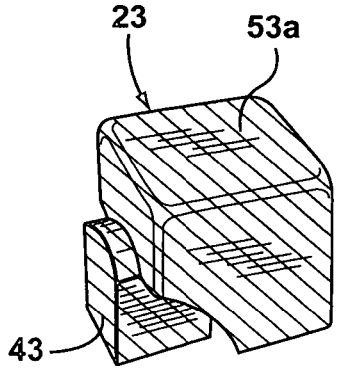
FIG. 7 is a perspective view of a mid-edge cubic element.

Referring to FIGS. 1, 3 and 4, illustrated therein is a manipulable puzzle cube 10 made in accordance with a preferred embodiment of the invention. Puzzle cube 10 is in the form of a 3×3×3 cube comprising 26 cubic elements 21, 22, 23 connected to an interior connecting element 24 (see FIG. 4).

The mechanics of puzzle cube 10 are preferably the same as those of a classic 3×3×3 Rubik's Cube. The mechanics of the Rubik's Cube were originally disclosed in Erno Rubik's Hungarian Patent No. 1,700,062, and these mechanics are now well known to those skilled in the art of puzzle cube mechanisms.

As in the case of a classic Rubik's Cube, the 3×3 arrays of cubic elements making up each face of puzzle cube 10 form plates of cubic elements which can be rotated about the X, Y and Z spatial axes of the cube. As shown in FIG. 3, top plate 40 is rotated by 45° about the Y axis of the cube.

Referring now to FIGS. 1, 4, 5, 6 and 7, as in the case of a classic Rubik's Cube, the cubic elements of puzzle cube 10 take three distinct forms, namely mid-face cubic elements 21, corner cubic elements 22, and mid-face cubic elements 23. Puzzle cube 10 comprises six mid-face cubic elements 21, eight corner cubic elements 22, and 12 mid-edge cubic elements 23. Mid-face cubic elements 21 have one exposed face 51*a*, corner cubic elements 22 have three exposed faces 52*a*, 52*b*, and 52*c*, and mid-edge cubic elements 23 have two exposed faces 53*a*, 53*b*.

Mid-face cubic element 21 includes a connector 41 which is rigidly connected to a sleeve portion 44 of interior connecting element 24. Mid-face elements 21 do not change position, but merely rotate about a spatial axis, when the plates of cubic elements are rotated by a user. Corner cubic elements 22 and mid-edge cubic elements 23 have connectors 42, 43 respectively, which slidingly interconnect with interior element 24, allowing cubic elements 22 and 23 to change positions as the plates of elements are rotated by the user.

Unlike the classic Rubik's Cube, in the case of the subject invention, all of the exposed faces of a given cubic element of puzzle cube 10 are the same colour, wherein the colour is selected from a group comprising at least two contrasting colours. Thus, as shown in FIG. 3, face 51*a* of mid-face cubic element 21 is of a first colour, faces 52*a*, 52*b* and 52*c* of corner cubic element 22 are of a second contrasting colour, and faces 53*a* and 53*b* of mid-face cubic element 23 are of the first colour.

All portions of the cubic elements of puzzle cube 10 are preferably the same colour, and the cubic elements are preferably made from coloured plastic. The cubic elements of puzzle cube 10 are preferably made of injection-molded plastic. This construction obviates the need to apply stickers or plates to different faces of a given cubic element.

The colour of each cubic element is selected to give each surface of puzzle cube 10 a distinctive decorative pattern which is appealing to the user's eye, when puzzle cube 10 is in its initial, undisturbed state. In the preferred embodiment shown in FIGS. 1, 2 and 3, the decorative pattern is the same on each surface of the cube. As shown, the decorative pattern is a "Y" pattern, utilizing two contrasting colours, such as red and white, in which one corner element, the mid-face element and two of the mid-edge elements not adjacent to the corner element are of a first contrasting colour, and the remaining cubic elements of the surface are of a second contrasting colour.

Figure 2:
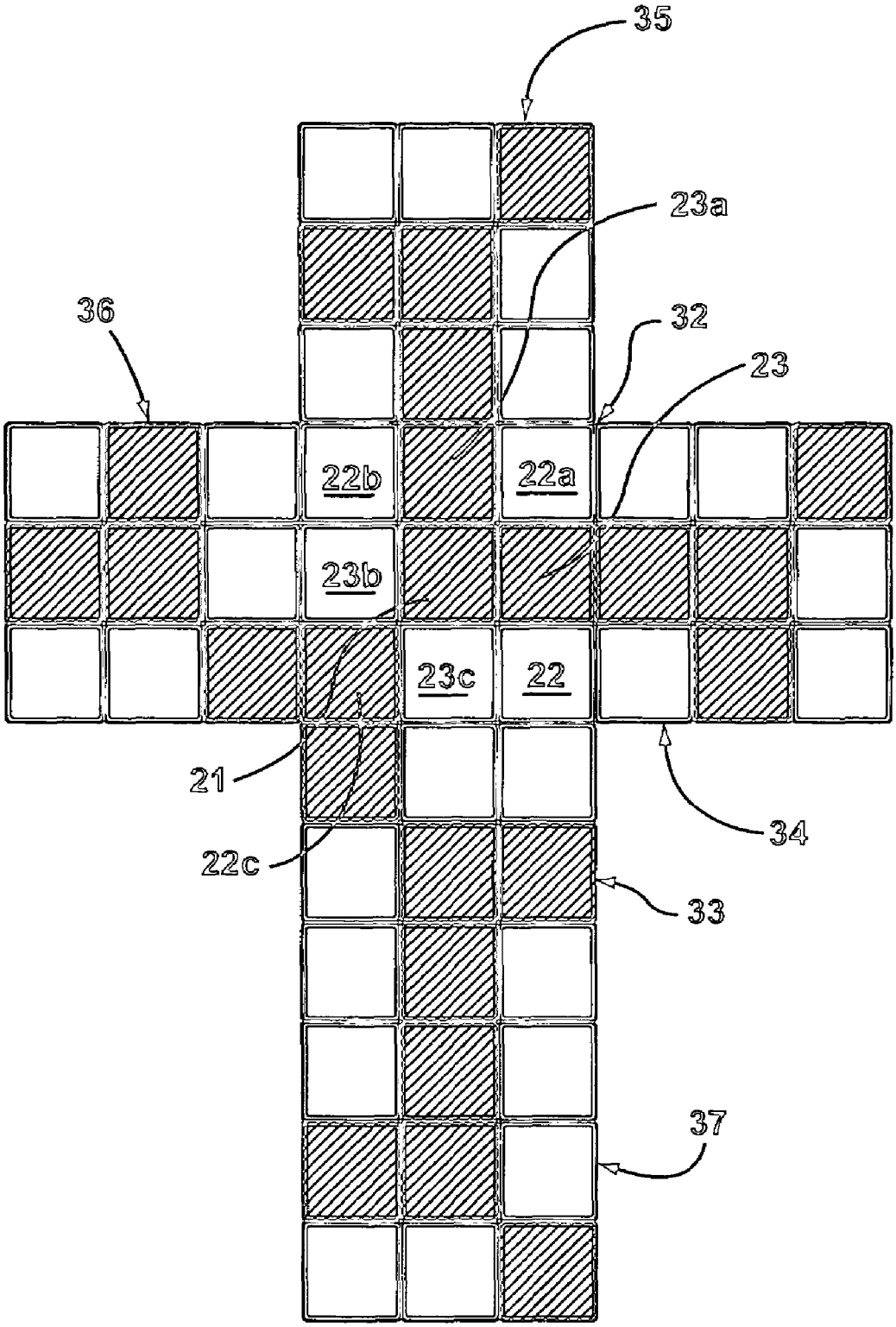
FIG. 2 is a schematic view of the decorative pattern of the preferred embodiment of the subject invention.

Referring now to FIG. 2, the cubic elements making up the top surface 32, left-front surface 33, the right-front surface 34, the right-back surface 35, and the left-back surface 36, and the bottom surface 37 of puzzle cube 10 all have the same decorative "Y" pattern. In the case of the top surface 32 of puzzle cube 10, mid-face element 21 is red, corner elements 22, 22*a* and 22*b* are white, corner element 22*c* is red, mid-face elements 23 and 23*a* are red, and mid-face elements 23*b* and 23*c* are white. This selection of colours produces a decorative pattern which is not only visually attractive, but which also represents a "no tic-tac-toe" pattern, in which there are no three elements of the same colour in a single row, column or diagonal.

Puzzle cube 10 is preferably packaged and sold with its cubic elements in their original, undisturbed positions, with the "Y" pattern displayed on all sides. In use, the plates of the puzzle cube 10 would be rotated by the user so as to disturb the "Y" pattern, and user would subsequently attempt to re-arrange the cubic elements by sequentially rotating various plates of elements, so as to restore the original "Y" pattern on all sides of the cube.

Puzzle cube 10 has a number of advantages over the classic Rubik's Cube. Puzzle cube 10 is more appealing to the eye, and easier for users to solve. The construction of puzzle cube 10 allows each of the cubic elements to be made of injection-molded plastic of a selected colour, and there is no need to apply stickers or plates to different faces of a given cubic element.

While puzzle cube 10 has a two colour "Y" pattern, it should be understood that puzzle cubes made in accordance with the subject invention may have different decorative patterns, as long as all of the exposed faces of a given cubic element are the same colour. Furthermore, while puzzle cube 10 has a pattern which utilizes only two colours, more than two colours could be utilized.

For example, illustrated in FIGS. 8–13 are puzzle cubes 60, 70, 80 made in accordance with the subject invention, having a variety of decorative patterns different from that of puzzle cube 10.

Figure 8:
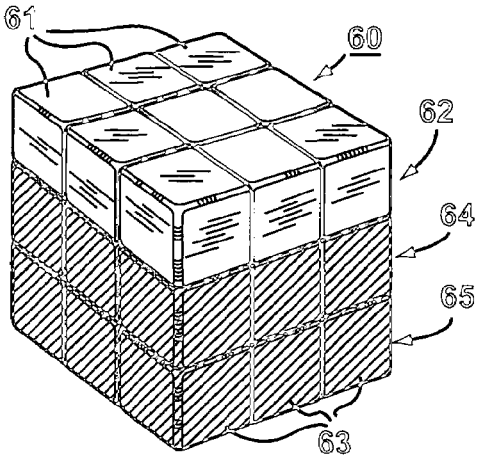
FIG. 8 is a perspective view of a manipulable puzzle cube made in accordance with a second embodiment of the invention.
Figure 9:
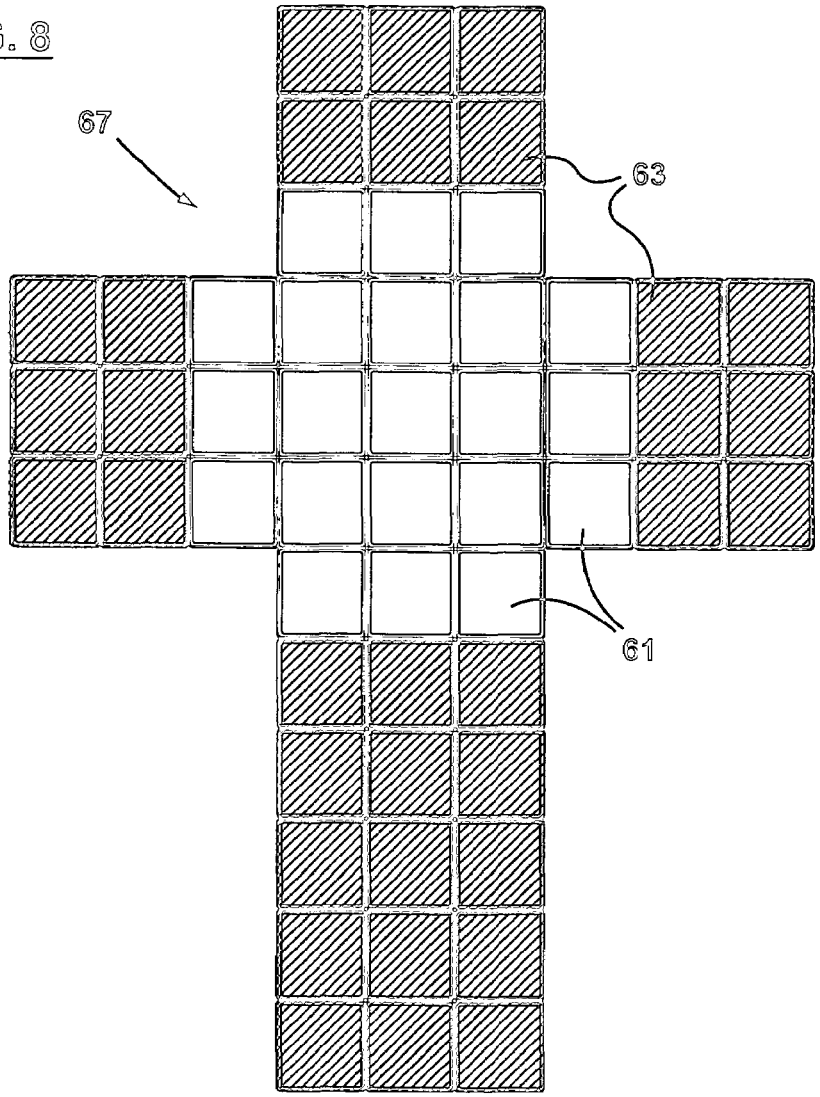
FIG. 9 is a schematic view of the decorative pattern of the second embodiment of the invention.

Referring to FIGS. 8 and 9, shown therein is puzzle cube 60 made in accordance with a second embodiment of the invention, having a decorative pattern 67 entitled "The Cake-Walk", consisting of a top layer of "icing" on a "chocolate brown" cake. All of the exposed faces of cubic elements 61 forming top plate 62 are white and all of the exposed faces of cubic elements 63 forming middle plate 64 and bottom plate 65 are brown.

Figure 10:
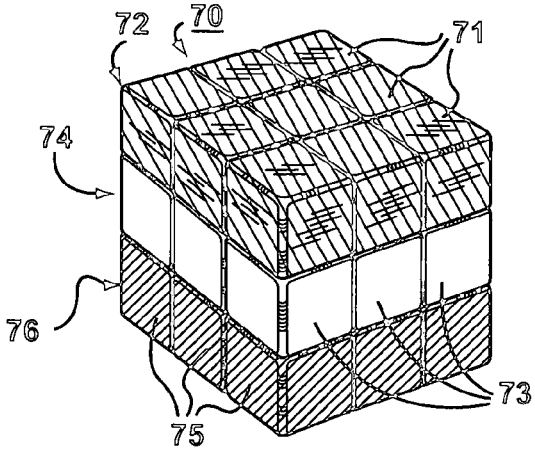
FIG. 10 is a perspective view of a manipulable puzzle cube made in accordance with a third embodiment of the invention.
Figure 11:
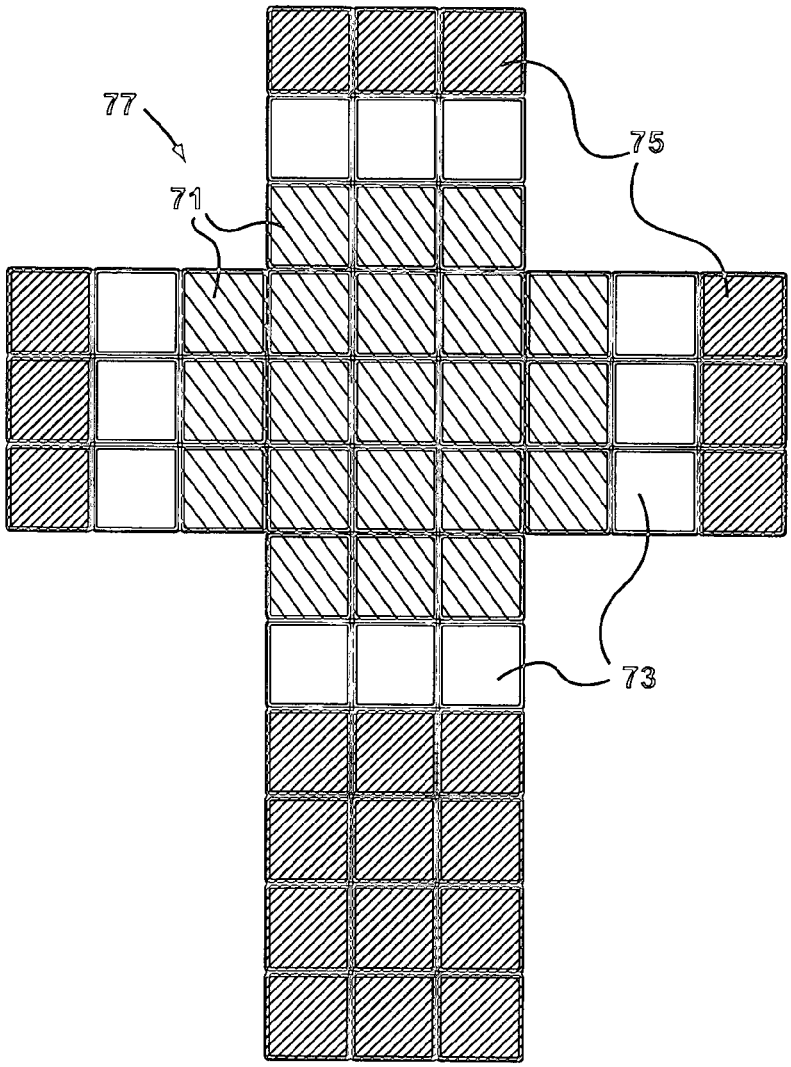
FIG. 11 is a schematic view of the decorative pattern of the third embodiment of the invention.

Referring now to FIGS. 10 and 11, illustrated therein is puzzle cube 70 made in accordance with a third embodiment of the invention, having a three-colour pattern 77 entitled "The Triclone". Cubic elements 71 making up top plate 72 are red, cubic elements 73 making up middle plate 74 are white, and cubic elements 75 making up bottom plate 76 are blue.

Figure 12:
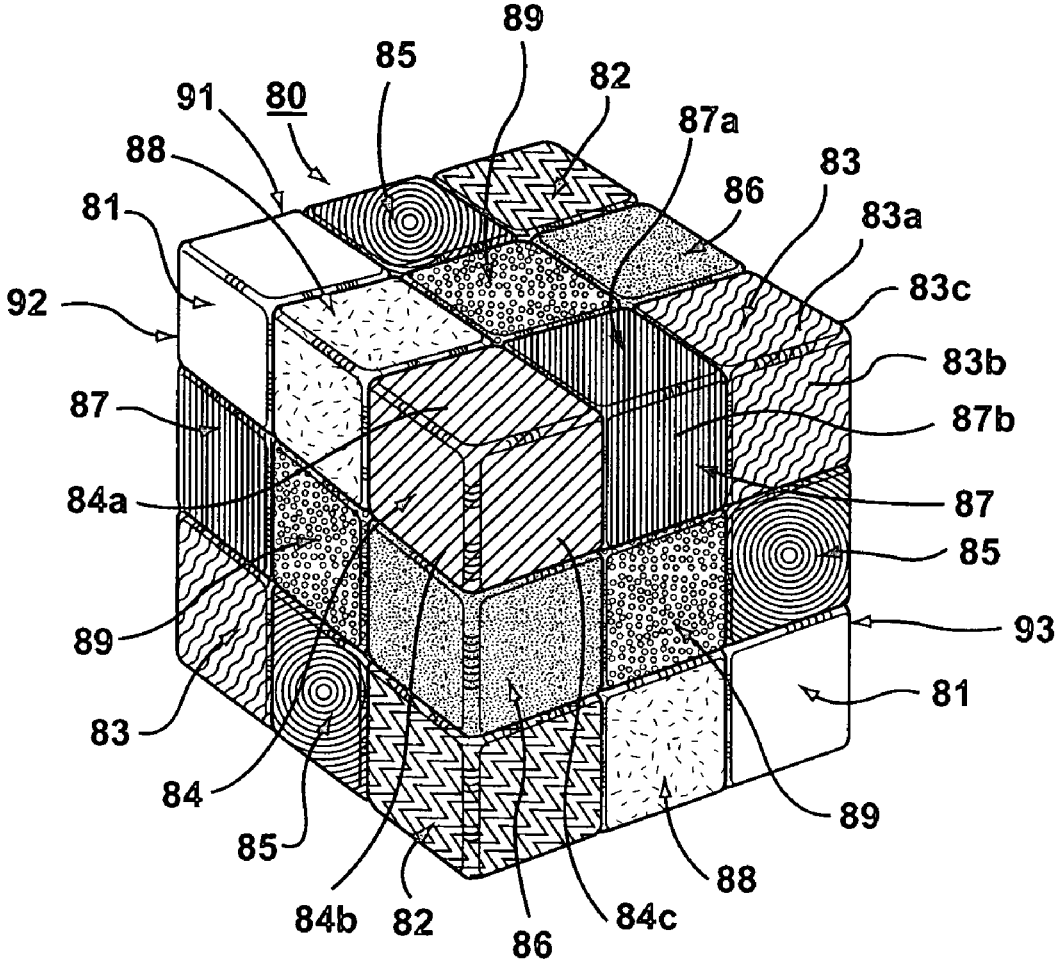
FIG. 12 is a top perspective view of a manipulable puzzle cube made in accordance with a fourth embodiment of the invention.
Figure 13:
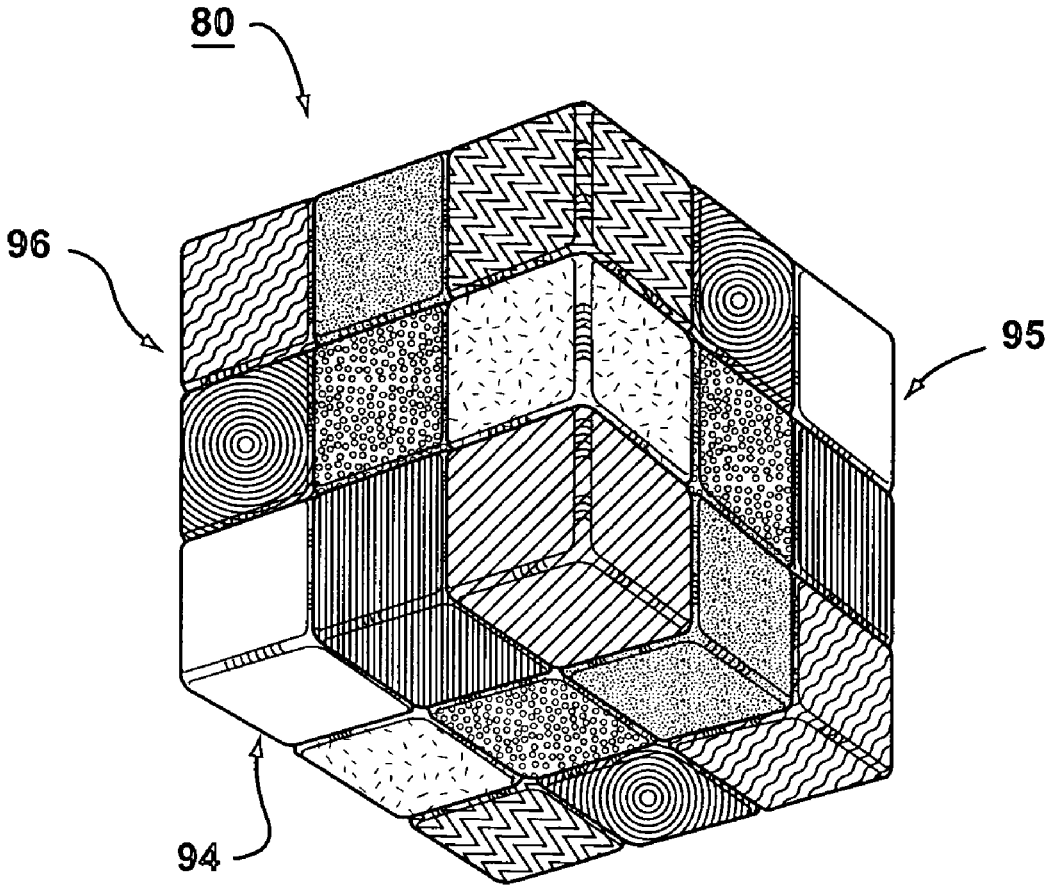
FIG. 13 is a bottom perspective view of the fourth embodiment of the invention.

Referring now to FIGS. 12 and 13, illustrated therein is puzzle cube 80 made in accordance with a fourth embodiment of the invention having nine-colour pattern, in which each of the cubic elements forming a given surface of cube 80 is a different colour, resulting in a total of nine different colours per surface. FIG. 12 is a top perspective view which shows the top surface 91, left front surface 92, and right front surface 93 of cube 80, and FIG. 13 is a bottom perspective which shows the bottom surface 94, left rear surface 95 and right rear surface 96.

Like puzzle cube 10, all of the exposed faces of a given cubic element of puzzle cube 80 are the same colour. Thus faces 84*a*, 84*b* and 84*c* of corner element 84 are of a first colour, faces 87*a* and 87*b* of mid-edge element 87 are of a second colour, and faces 83*a*, 83*b* and 83*c* of corner element 83 are of a third colour, and so on.

The arrangement of the nine colours is not exactly the same on each of the six surfaces of cube 80, but each surface contains the same nine different colours. Puzzle cube 80 has four pairs of same colour diagonally opposed corner elements, and the colour of each pair is different from that of other pairs. Thus corner elements 81 may be white, corner elements 82 may be red, corner elements 83 may be brown, and corner elements 84 (only one is shown in FIG. 12) may be black. Puzzle cube 80 has four triples of same colour mid-edge elements, and the colour of each triple is different. Thus mid-edge elements 85 may be yellow, mid-edge elements 86 may be green, mid-edge elements 87 may be orange, and mid-edge elements 88 may be purple. The mid-edge elements of a given triple are equal-distantly spaced from each other. Puzzle cube 80 also has six same colour mid-face elements 89, which may be blue.

While the subject invention is described and illustrated with respect to certain preferred and alternative embodiments, it should be understood that various modifications can be made to those embodiments without departing from the subject invention, the scope of which is defined in the following claims.

What is claimed is:

1. A manipulable puzzle cube, comprising a plurality of cubic elements connected to a centrally positioned interior connecting element, the cubic elements of each surface of the cube forming a plate of cubic elements, the plate being rotatable about a spatial axis of the cube, each of the cubic elements having one or more exposed faces, wherein all portions of each of the cubic elements are formed from a material having a selected colour, whereby all of the exposed faces of a given cubic element are the same colour, the colour being selected from a group of colours comprising at least two different colours, wherein the colour of each cubic element is selected so that the cubic elements form a decorative pattern on each surface of the cube, when the cube is in an undisturbed state, the decorative pattern being formed by the at least two different colours.

2. The puzzle cube defined in claim 1, wherein the decorative pattern is the same on each surface of the cube.

3. The puzzle cube defined in claim 1, wherein the group of colours comprises a first colour and a second contrasting colour.

4. The puzzle cube defined in claim 1, wherein the cube is a 3×3×3 cube comprising 26 cubic elements connected to the interior connecting element, with each surface of the cube comprising a 3×3 array of cubic elements, the array having three rows of cubic elements, three columns of cubic elements, and two diagonals of cubic elements.

5. The puzzle cube defined in claim 4, wherein the decorative pattern comprises a "Y" pattern, wherein in the case of each surface of the cube, one corner element, the mid-face element and two of the mid-edge elements not adjacent to the corner element are of a first colour, and the remaining cubic elements of the surface are of the contrasting colour.

6. The puzzle cube defined in claim 4, wherein the decorative pattern comprises a no "tic-tac-toe" pattern, wherein the cubic elements making up each of the rows, the columns, and the diagonals of the array are not of the same colour.

7. The puzzle cube defined in claim 2, comprising 26 cubic elements, wherein the 26 cubic elements comprise eight corner cubic elements having three exposed faces, 12 mid-edge cubic elements having two exposed faces, and six mid-face cubic elements having one exposed face.

8. The puzzle cube defined in claim 1, wherein the material is coloured plastic.

9. The puzzle cube defined in claim 8, wherein the cubic elements are injection-molded.

10. The puzzle cube defined in claim 1, wherein the decorative pattern resembles the appearance of a cake, wherein the cubic elements forming a top plate of the cube are of a first colour, and the cubic elements forming a middle plate of the cube and a bottom plate of the cube are of a second colour.

11. The puzzle cube defined in claim 1, wherein the decorative pattern is a three-colour pattern, wherein the cubic elements making up a top plate of the cube are a first colour, the cubic elements making up a middle plate of the cube are a second colour, and the cubic elements making up a bottom plate of the cube are a third colour.

12. The puzzle cube defined in claim 1, wherein the decorative pattern is a nine-colour pattern, wherein each of the cubic elements forming a given surface of the cube is a different colour.

13. The puzzle cube defined in claim 1, wherein the cube is a 3×3×3 cube comprising 26 cubic elements connected to the interior connecting element, with each surface of the cube comprising a 3×3 array of cubic elements, the colour selected from a group of colours comprising at least two contrasting colours.

14. The puzzle cube defined in claim 13, wherein the decorative pattern comprises a "Y" pattern, wherein in the case of each surface of the cube, one corner element, the mid-face element and two of the mid-edge elements not adjacent to the corner element are of a first colour, and the remaining cubic elements of the surface are of the contrasting colour.

15. The puzzle cube defined in claim 13, wherein the decorative pattern comprises a no "tic-tac-toe" pattern, wherein the cubic elements making up each of the rows, the columns, and the diagonals of the array are not of the same colour.

16. The puzzle cube defined in claim 13, wherein the decorative pattern resembles the appearance of a cake, wherein the cubic elements forming a top plate of the cube are of a first colour, and the cubic elements forming a middle plate of the cube and a bottom plate of the cubic are of a second colour.

17. The puzzle cube defined in claim 13, wherein the decorative pattern is a three-colour pattern, wherein the cubic elements making up a top plate of the cube are a first colour, the cubic elements making up a middle plate of the cube are a second colour, and the cubic elements making up a bottom plate of the cube are a third colour.

18. The puzzle cube defined in claim 13, wherein the decorative pattern is a nine-colour pattern, wherein each of the cubic elements forming a given surface of the cube is a different colour.

19. A manipulable puzzle cube, comprising a plurality of cubic elements connected to a centrally positioned interior connecting element, the cubic elements of each surface of the cube forming a plate of cubic elements, the plate being rotatable about a spatial axis of the cube, each of the cubic elements having one or more exposed faces, wherein each of the cubic elements is integrally formed from a plastic material of a selected colour, the colour being selected from a group of colours comprising at least two different colours, and wherein the cubic elements are arranged so that the cubic elements form a decorative pattern on each surface of the cube, the decorative pattern being formed by the at least two different colours, wherein the decorative pattern is disturbed when the cubic elements are rearranged by random manipulation of the plate, thereby creating a challenging puzzle.

* * * * *